US006681704B1

(12) United States Patent
Brookhiser

(10) Patent No.: US 6,681,704 B1
(45) Date of Patent: Jan. 27, 2004

(54) ROTARY POSITIONING TABLE

(76) Inventor: William David Brookhiser, 1204 Columbus Cir., Janesville, WI (US) 53545

( * ) Notice: Subject to any disclaimer, the term of this patent is extended or adjusted under 35 U.S.C. 154(b) by 0 days.

(21) Appl. No.: 10/192,029

(22) Filed: Jul. 10, 2002

(51) Int. Cl.[7] ..... A47B 3/00
(52) U.S. Cl. ..... 108/115
(58) Field of Search ..... 108/115, 116, 108/129, 130, 95, 921, 91; 248/188.6, 188.7, 188.1

(56) References Cited

U.S. PATENT DOCUMENTS

| | | | | |
|---|---|---|---|---|
| 1,979,843 A | * | 11/1934 | Roos | 108/159 |
| 2,055,007 A | | 9/1936 | Erpelding | |
| 2,706,670 A | * | 4/1955 | Heifetz | 108/115 |
| 3,080,193 A | * | 3/1963 | Nimmo | 297/158.4 |
| 3,188,158 A | | 6/1965 | Sanchez | |
| 3,415,208 A | * | 12/1968 | Thoresen et al. | 108/94 |
| 3,805,710 A | | 4/1974 | Leshem | |
| 5,154,127 A | | 10/1992 | Booth | |
| 5,205,223 A | * | 4/1993 | Ball et al. | 108/124 |
| 5,224,531 A | * | 7/1993 | Blohm | 144/285 |
| 5,325,794 A | * | 7/1994 | Hontani | 108/117 |
| 5,584,254 A | | 12/1996 | Williams | |
| 5,765,796 A | | 6/1998 | Lanus | |
| 6,041,723 A | | 3/2000 | Peterson | |
| 6,089,167 A | | 7/2000 | Frohardt | |
| 6,196,138 B1 | | 3/2001 | Sakai et al. | |
| 6,220,184 B1 | | 4/2001 | Sack | |
| 6,257,153 B1 | * | 7/2001 | Portugal | 108/115 |
| 6,314,892 B1 | | 11/2001 | Favini | |
| 6,405,660 B2 | * | 6/2002 | Itakura et al. | 108/115 |

FOREIGN PATENT DOCUMENTS

EP 0072570 * 8/1981

* cited by examiner

*Primary Examiner*—Jose V. Chen
(74) *Attorney, Agent, or Firm*—Hinkle & O'Bradovich, LLC

(57) ABSTRACT

A rotary positioning table is disclosed. The table generally includes a table top and a central support structure, in which the table top can rotate about a point of rotation, typically a rotary bearing, with respect to the central support structure, thus enabling a user to generally be able to stay in the same position while rotating the table top to a desired position. The central support structure generally includes a top frame connected to and generally parallel to the table top, a center frame connected to and generally perpendicular to the top frame and an end frame connected to and generally perpendicular to either side of the center frame, wherein the end frames are generally perpendicular to the top frame. The frames can all be folded generally parallel to a common reference place for ease of transport and storage.

10 Claims, 4 Drawing Sheets

ROTARY POSITIONING TABLE

BACKGROUND OF THE INVENTION

I. Field of the Invention

The present invention relates generally to the field of worktables and more particularly to a portable work table having a rotary work surface and the ability to be compactly folded for ease of transport and storage.

II. Description of the Related Art

Projects that involve work surfaces or work tables are often limited in flexibility. For example, work surfaces are typically stationary forcing a user to walk around the table to get to the different sides of the table. Furthermore, the tables are often unable to be folded down for ease of movement and storage.

SUMMARY OF THE INVENTION

In general the invention features a rotary positioning table having the ability to be folded down into a stored configuration. The table typically includes a flat table top that is positioned upon a center supporting structure and is mounted to the center supporting structure by a "lazy Susan"-type device so that the table can rotate to easily position a workpiece with respect to the user. The table and table top are supported by a pair of leg structures or end frames, all of which can fold into an easily transported and storable configuration.

In general, in one aspect, the invention features a work table, including a center support structure and a table top connected to the center support structure.

In one implementation, the center support structure includes a top frame connected to and generally parallel to the table top, a center frame connected to and generally perpendicular to the top frame and an end frame connected to and generally perpendicular to either side of the center frame, wherein the end frames are generally perpendicular to the top frame.

In another implementation, the table includes a point of rotation located between the table top and the top frame.

In another implementation, the point of rotation is a rotary bearing.

In another implementation, the top frame is pivotally connected to the center frame.

In another implementation, the center frame is pivotally connected to the end frames.

In another implementation, the top frame is adapted to rotate toward the center frame.

In another implementation, the end frames are adapted to rotate toward the center frame.

In another implementation, the top frame, the center frame and the end frames can be oriented generally parallel to each other in a stored configuration.

In another implementation, the table top comprises a work surface and a support frame connected to the work surface, wherein the support frame is connected to the central support structure.

In still another implementation, the table includes a rotary bearing connected between the table top and the central support structure.

In yet another implementation, the table top can rotate with respect to the central support structure about the rotary bearing.

In another implementation, the table includes flanges connected to the central support structure.

In another implementation, the flanges can be pivoted to inhibit the rotation of the table top.

In another implementation, the table includes a knob screw connected to the central support structure and adapted to contact the table top to inhibit the rotation of the table top.

In another aspect, the invention features work table kit, including a work table having a center support structure and a table top connected to the center support structure, the central support structure having a top frame connected to and generally parallel to the table top, a center frame connected to and generally perpendicular to the top frame, an end frame connected to and generally perpendicular to either side of the center frame, wherein the end frames are generally perpendicular to the top frame, each of the end frames having a footer, and a rotary bearing connected between the table top and the central support structure so that the table top can be rotated with respect to the central support structure and a footer connection.

In one implementation, the footer connection is a caster.

In another implementation, the connection is a roller.

In another implementation, the connection is a heightening system.

In another implementation, the connection is a leveling system.

In another aspect, the invention features a work table, including a table top, a central support structure having a top frame connected to and generally parallel to the table top, a center frame connected to and generally perpendicular to the top frame and an end frame connected to and generally perpendicular to either side of the center frame, wherein the end frames are generally perpendicular to the top frame and means to rotate the table top with respect to the central support structure.

One advantage of the invention is that it has a rotary work surface enabling flexible working conditions.

Another advantage is that the user has to move less than with conventional work tables.

Another advantage is that the work surface can be rotated though 360 degrees.

Another advantage is that the table can be folded down and stored.

Another advantage of the invention is that it can be positioned into corners as needed.

Other objects, advantages and capabilities of the invention will become apparent from the following description taken in conjunction with the accompanying drawings showing the preferred embodiment of the invention.

DETAILED DESCRIPTION OF THE INVENTION

Figure 1:
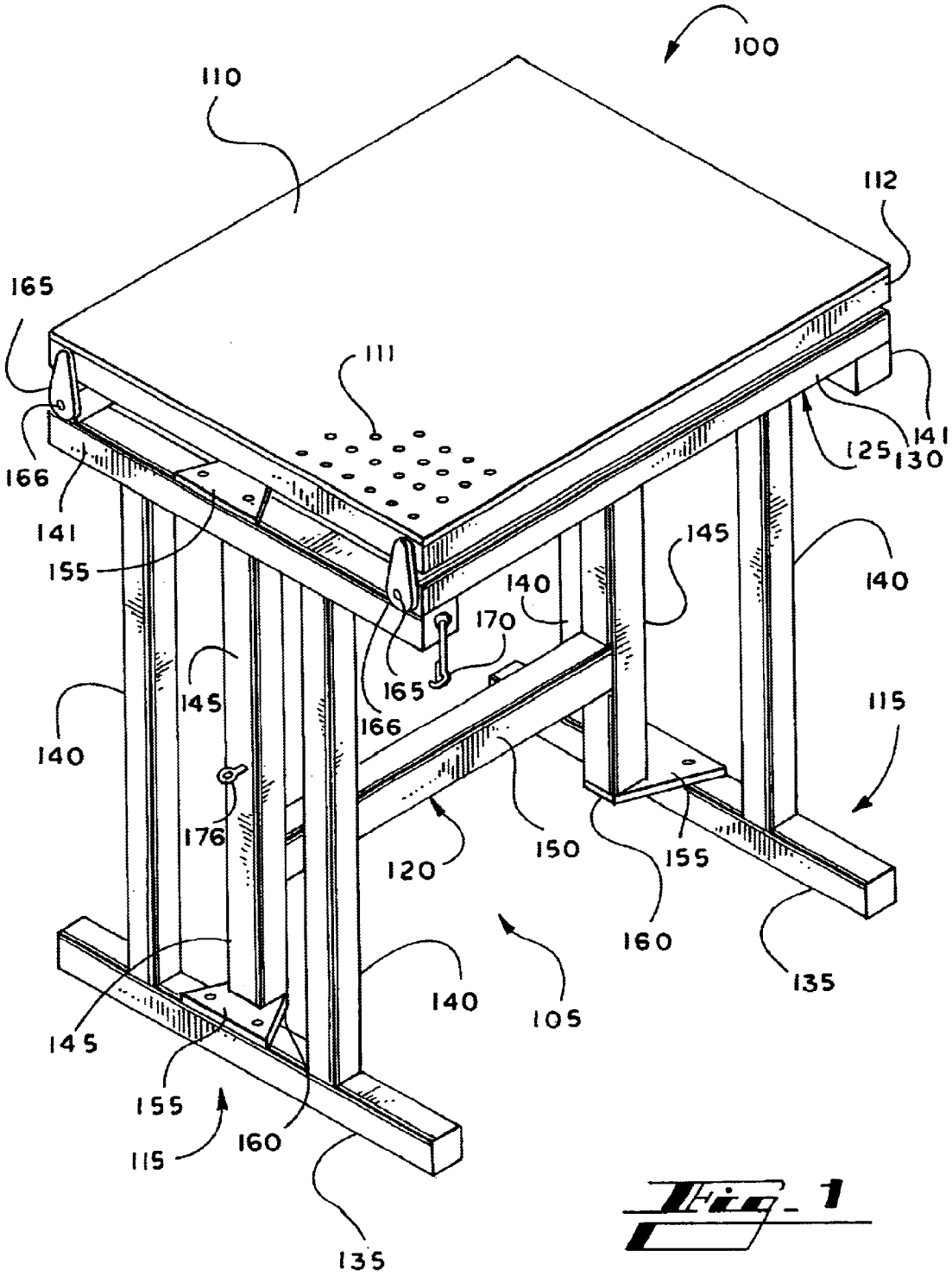
FIG. 1 illustrates a perspective view of an embodiment of a rotary positioning table.

Referring to the drawings wherein like reference numerals designate corresponding parts throughout the several figures, reference is made first to FIG. 1 that illustrates a perspective view of an embodiment of a rotary positioning table 100. The table 100 generally includes a central support structure 105 connected to a work surface 110 having a support frame 112. The work surface and the support frame generally form a table top. The central support structure 105 has several constituent components described in detail in the discussion below. The work surface 110 is typically rotatably connected to the support structure 105 as is discussed in further detail below. In general, the rotating table top can be viewed as a "lazy Susan". In general, the surface 110 is connected to the central support structure 105 at a point of rotation. In one embodiment, the point of rotation is a rotary bearing that typically includes nested circular frames that rotate with respect to each other. One of the circular frames is connected to the underside of the surface 110 and the other circular frame is connected to the central support structure 105. Generally, the surface 110 can rotate through a full 360 degrees. The work surface 110 can have a variety of features. In general, the surface is preferably durable and can be wood, metal or any suitable working surface. The one implementation, the surface can include a variety of peg holes 111. A variety of implements can be inserted into the peg holes 111 for a variety of purposes. For example, hooks can be inserted into the peg holes 111 in order to secure objects on the surface 110. In another example, straps can be tied around the surface 110 and secured to the hooks in order to secure objects. In another embodiment, the surface 110 can be made of a material that is easily washable. In another embodiment, the surface 110 can be coated or include anti-skid rubber. In still another embodiment, the surface 110 can include a cover made of a material different from the surface 110 in order to have flexibility in the choice of material for the work surface 110. In another embodiment, the surface 110 can include a variety of depressions or containers that can be used to hold tools, small objects and the like.

The support structure 105 generally includes two end frames 115 connected to a center frame 120. The end frames 115 and the end frame are connected to a top frame 125. The surface 110 is rotatably connected to the top frame 125. The top frame 125 is generally a square or rectangular shape. Side beams 130 define outer edges of the perimeter of the top frame 125. There are also one or more cross beams (not shown) that support the point of rotation of the surface 110 with respect to the top frame 125 and the other constituent components of the central support structure 105. Each of the end frames 115 generally includes a footer 135 and two elongated beams 140 with one end connected generally perpendicular to the footer 135 and generally parallel to each other. The footers 135 can include levelers so that the work surface can be suitably leveled if it is on an uneven floor. The footers 135 can also include wheels, rollers, casters and the like in so that the table 100 can be easily moved from position to position as needed. The wheels, rollers, casters and the like can include locks so that the table 100 does not roll around. The footers 135 can also include additional rods that can be locked to the footers 135 with a locking screw. The rods could be used in conjunction to adjust the overall height of the table 100. Any of the above mentioned features of the footers 135 can be integral with the footers 135 or can be added as kit features. The other end of the beams 140 is connected to head beams 141 of the end frame 115. The ends of the perimeter beams 130 generally lie on top of a portion of the head beams 141. The center frame 120 generally includes two elongated beams 145 generally parallel to each other with one or more cross beams 150 connected between and generally perpendicular to the elongated beams 145. The elongated beams are connected to plates 155 at a point of rotation 160. The elongated beams are adapted to rotate about the plates 155. Plates 155 are located on the footers 135 and on head beams 141 and are arranged generally parallel to the ground. In another embodiment, the plates 155 can be replaced by one or more smaller plates that can also function as a point of rotation.

The table 100 further includes flanges 165 rotatably connected to perimeter beams 130. The flanges 165 can be rotated about a point of rotation 166 into a position so that the surface 110 is inhibited from rotating. In one embodiment, two flanges 165 are used in conjunction to keep the surface 110 in a stationary position. In another embodiment, the top frame 125 can include a lock (not shown) that can lock the surface 110 into any position along a full rotation. The lock can include a knob screw mounted beneath the surface 110. One end of the knob screw can include a rubber tip that can engage the underside of the surface 110 when screwed into place thereby causing enough friction to keep the surface from freely rotating.

The table 100 further includes a hook 170 that can be used to lock the perimeter beam 130 to the header beam 141 in order to keep the table 100 from folding in an unwanted position. An eye 176 is also shown that can be used in conjunction with another hook when the table 100 is in a stored configuration as described further below. In one embodiment, the hook is connected to one of the header beams 141 and the eye 176 is connected to one of the elongated beams 145 of the center frame 120.

Figure 2:
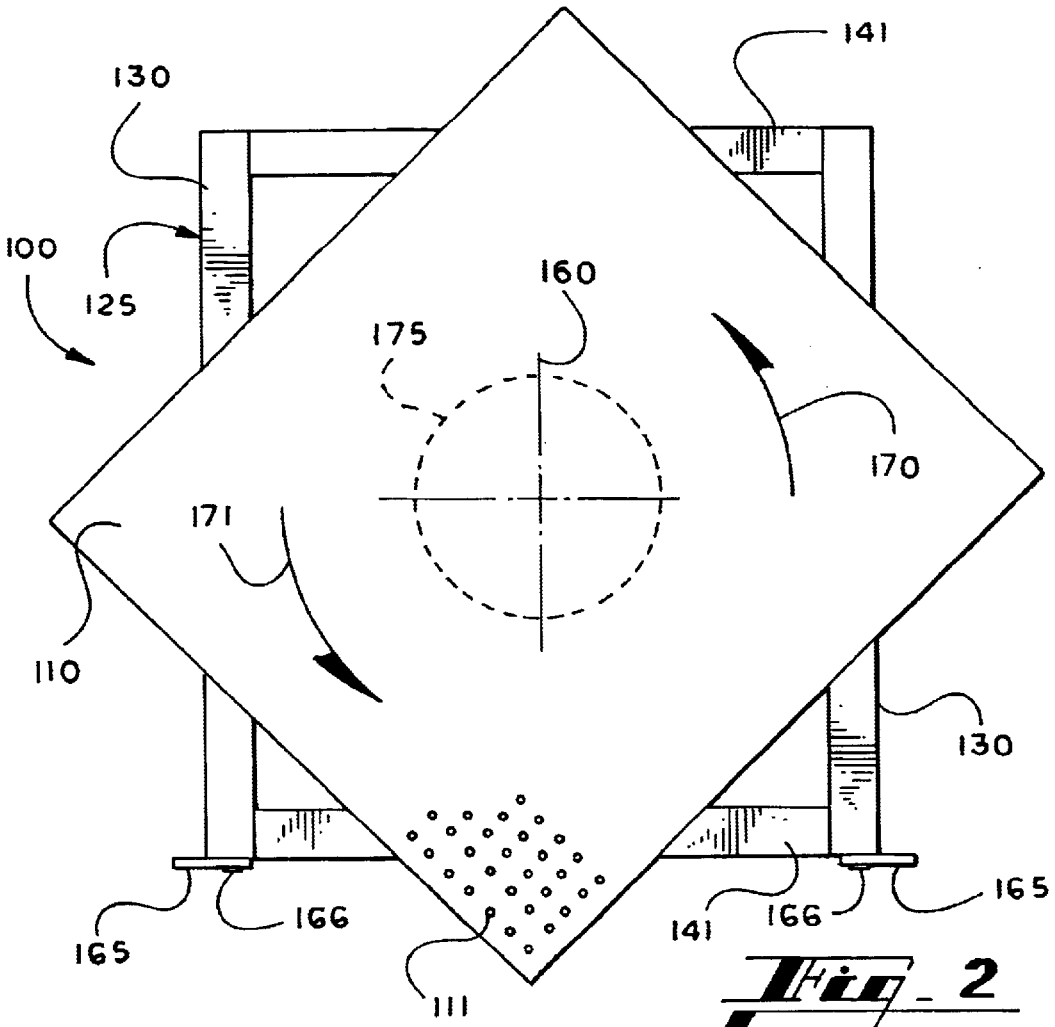
FIG. 2 illustrates a top view of an embodiment of a rotary positioning table.

FIG. 2 illustrates a top view of an embodiment of a rotary positioning table 100. The view illustrates the surface 110, including peg holes 111, rotating with respect to the top frame 125 through arrows of rotation 171. A partial view of rotation point 175 (rotary bearing) is shown in phantom and a partial view of cross beams 180 that connect to perimeter beams 130 is also shown in phantom. The perimeter beams 130 rest generally on the header beams 141. Note that the rotation point 175 can be connected to either the surface 110 or the support frame 112. The flanges 165 have been rotated about pivot points 166 to allow rotation of the surface 110.

Figure 3:
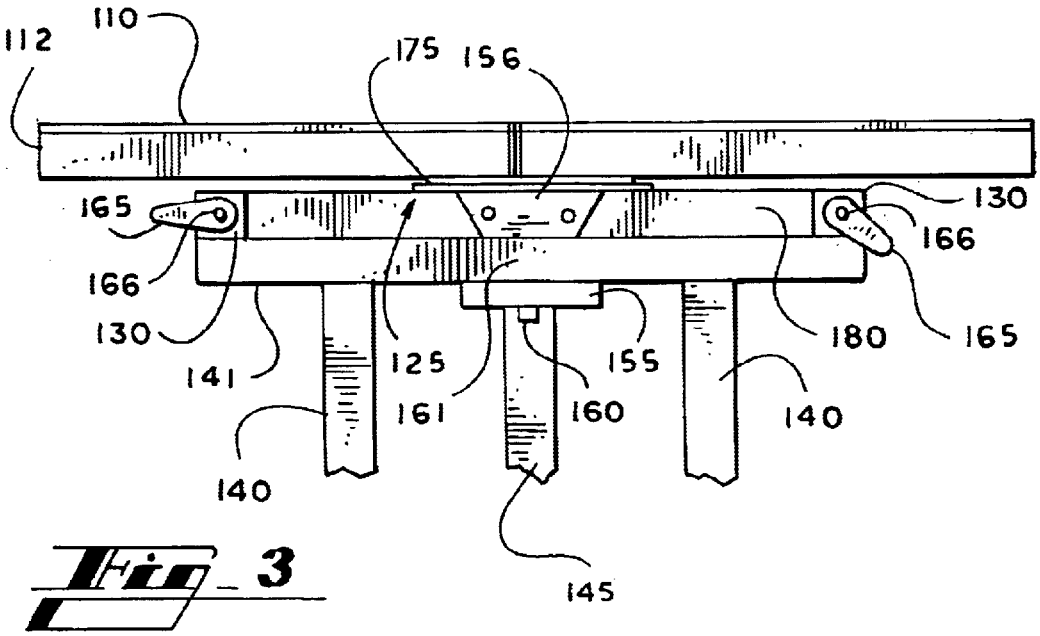
FIG. 3 illustrates a side view of a portion of an embodiment of a rotary positioning table.

FIG. 3 illustrates a side view of a portion of an embodiment of a rotary positioning table 100. The side view illustrates The surface 110, the support frame 112, the perimeter beams 130 of the top frame 125 resting on header beam 141, a cross beam 180 of the top frame 125, the rotation point 175 (rotary bearing) between the support frame 112 and the top frame 125, elongated beams 140 of the end frame 115 and elongated beam 145 of center frame 120. The figure also illustrates flanges 165 rotated about pivot points 166. The figure further illustrates vertical plates 156 similar to the horizontal plates 155 as originally illustrated in FIG. 1. The vertical plates 156 are oriented generally perpendicular to the ground with a point of rotation 161 on elongated beam 145.

Figure 4:
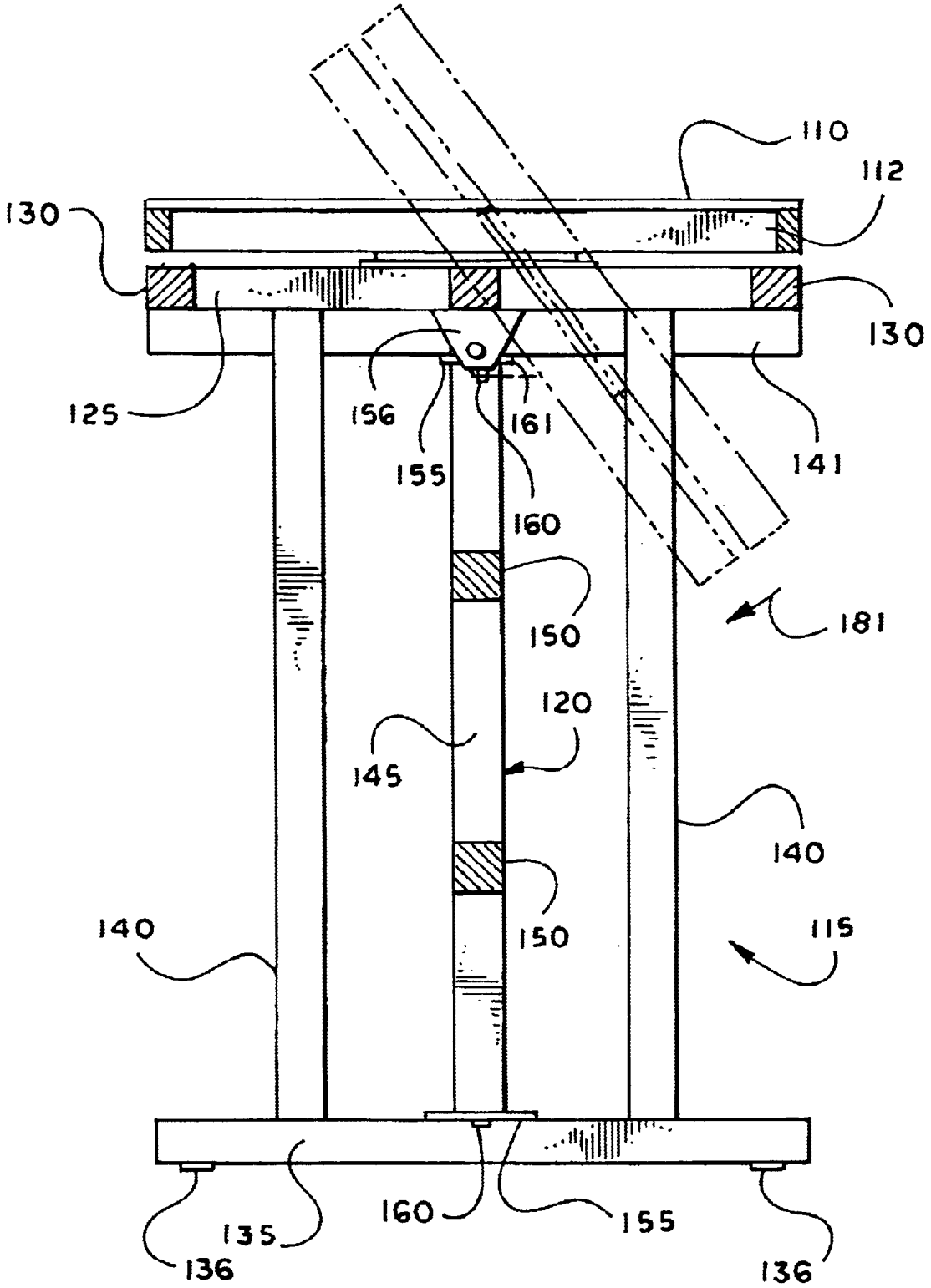
FIG. 4 illustrates a side view of an embodiment of a rotary positioning table.
Figure 5:
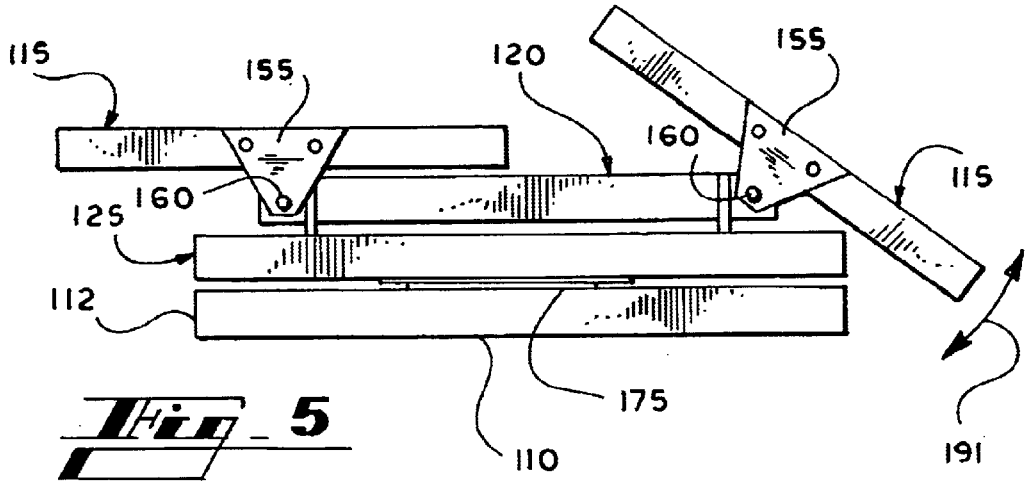
FIG. 5 illustrates a top view of an embodiment of a rotary positioning table.
Figure 6:
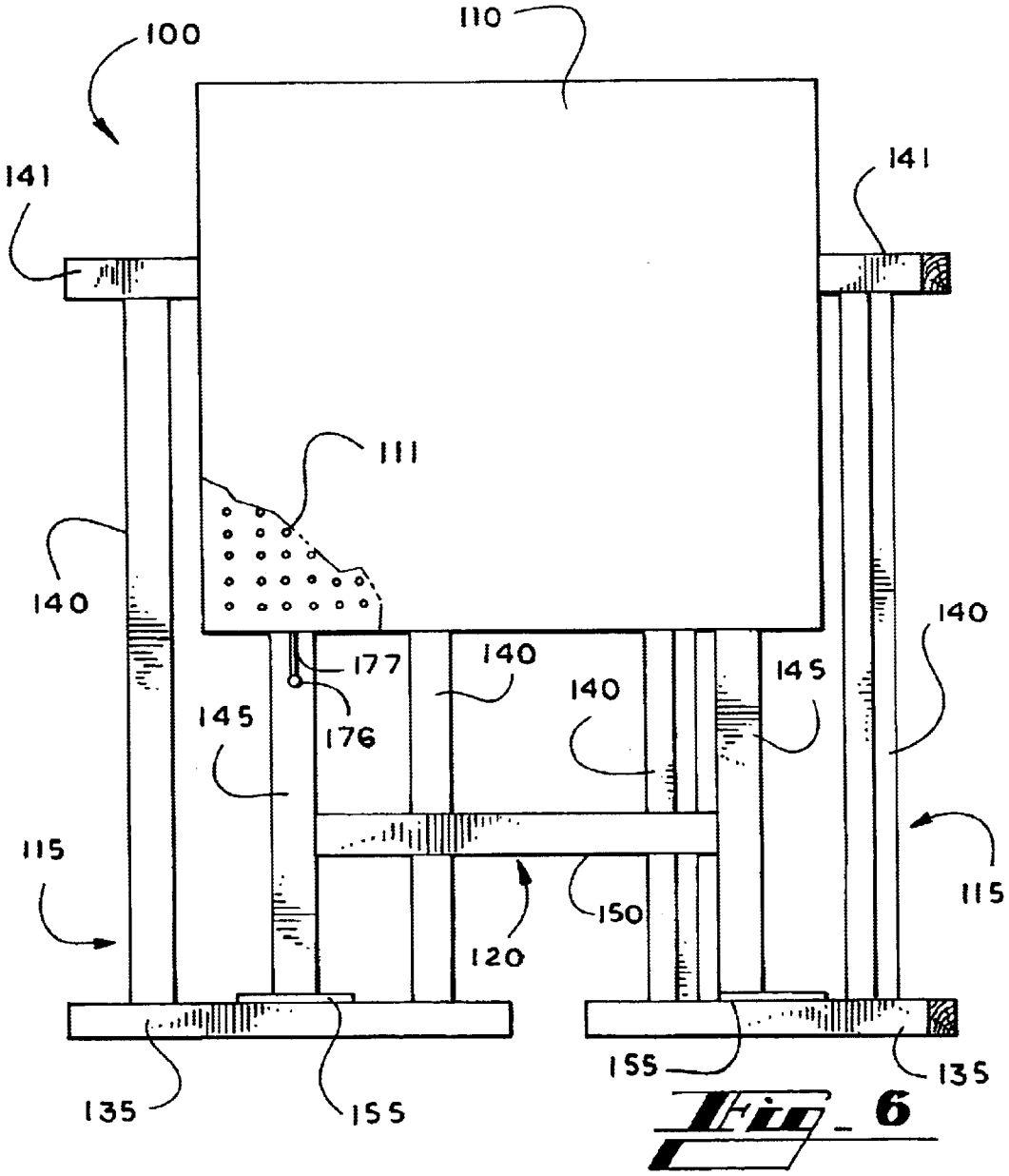
FIG. 6 illustrates a front view of an embodiment of a rotary positioning table in a stored configuration.

The discussion now generally turns to folding the table 100 down for movement and storage. FIGS. 4–6 illustrate how the table 100 can be folded down.

FIG. 4 illustrates a side view of an embodiment of a rotary positioning table 100. In general, the surface 110 and support frame 112 are locked with respect to the top frame 125 for ease of movement. Both end frames 115 can be rotated slightly about the pivot point 160. When the end frames 115 are rotated slightly, the perimeter beams 130 are able to pass by the header beams 141 so that the surface 110, support frame 112, and top frame 125 can rotate in conjunction about pivot point 161 and along an arrow of rotation 181. When the surface 110, support frame 112 and top frame 125 are fully rotated in this manner, they become positioned generally parallel to the center frame 120. The side view also illustrates a type of caster 136 that can be added to the footers 135.

FIG. 5 illustrates a top view of an embodiment of a rotary positioning table 100. In this figure, the surface 110, support frame 112 and top frame 125 have been fully rotated as illustrated in FIG. 4 and are now positioned generally parallel to the center frame 120. The end frames 115 can now be rotated about pivot point 160 and along an arrow of rotation 191. In this way, the end frames 115 can be fully rotated to a position generally parallel to the surface 110, the support frame 112, the top frame 125 and the center frame 120. In this way, the end frames 115, the surface 110, the support frame 112, the top frame 125 and the center frame 120 are all generally parallel to a common reference plane, thereby allowing a minimum space for transport and storage.

FIG. 6 illustrates a front view of an embodiment of a rotary positioning table 100 in a stored configuration. As described above, the end frames 115, the surface 110, the support frame 112, the top frame 125 and the center frame 120 are all generally parallel to a common reference plane for ease of transport and storage. One of the end frames 115 is shown in a slightly rotated position from this common reference plane to illustrate how the end frames 115 rotate in this view. A hook 177 is engaged with an eye 176 to prevent unwanted rotation of the surface 110, support frame 112 and top frame 125. Other hooks and eyes can be added in suitable locations to prevent other unwanted rotations while the table 100 is transported and stored. It is understood that the ability of the table 100 to be folded down so that the end frames 115, the surface 110, the support frame 112, the top frame 125 and the center frame 120 are all generally parallel to a common reference plane enables the table 100 to be compactly transported and stored.

The foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. A work table, comprising:

a table top;

a center support structure including:

a top frame connected to and generally parallel to the table top;

a center frame connected to and generally perpendicular to the top frame;

an end frame connected to and generally perpendicular to either side of the center frame, wherein the end frames are generally perpendicular to the top frame; and wherein the top frame is pivotally connected to the center frame and thus adapted to rotate toward the center frame.

2. The table as claimed in claim 1 further comprising a point of rotation located between the table top and the top frame.

3. The table as claimed in claim 2, wherein the point of rotation is a rotary bearing.

4. The table as claimed in claim 1, wherein the end frames pivotally connected to the center frame and thus are adapted to rotate toward the center frame.

5. The table as claimed in claim 4, wherein the top frame, the center frame and the end frames can be oriented generally parallel to each other in a stored configuration.

6. The work table as claimed in claim 1 further comprising a footer connection.

7. The work table as claimed in claim 6 wherein the footer connection is a caster.

8. The work table as claimed in claim 6 wherein the footer connection is a roller.

9. The work table as claimed in claim 6 wherein the footer connection is a heightening system.

10. The work table as claimed in claim 6 wherein the footer connection is a leveling system.

* * * * *